US011896885B2

(12) United States Patent
Na

(10) Patent No.: US 11,896,885 B2
(45) Date of Patent: Feb. 13, 2024

(54) GOLF PUTTING PRACTICE DEVICE AND AUXILIARY FASTENING UNIT FOR PUTTER HEAD

(71) Applicant: Jong Kap Na, Seoul (KR)

(72) Inventor: Jong Kap Na, Seoul (KR)

( * ) Notice: Subject to any disclaimer, the term of this patent is extended or adjusted under 35 U.S.C. 154(b) by 233 days.

(21) Appl. No.: 17/600,601

(22) PCT Filed: Apr. 13, 2020

(86) PCT No.: PCT/KR2020/004993
§ 371 (c)(1),
(2) Date: Oct. 1, 2021

(87) PCT Pub. No.: WO2020/226291
PCT Pub. Date: Nov. 12, 2020

(65) Prior Publication Data

US 2022/0193519 A1 Jun. 23, 2022

(30) Foreign Application Priority Data

May 8, 2019 (KR) ..... 10-2019-0053418

(51) Int. Cl.
*A63B 69/36* (2006.01)
*A63B 53/04* (2015.01)

(52) U.S. Cl.
CPC ..... *A63B 69/3685* (2013.01); *A63B 53/0487* (2013.01)

(58) Field of Classification Search
CPC . A63B 69/3685; A63B 53/0487; A63B 21/02; A63B 69/36211; A63B 69/3676
USPC ..... 473/219, 226, 229, 257, 258, 260–265
See application file for complete search history.

(56) References Cited

U.S. PATENT DOCUMENTS

| | | | | |
|---|---|---|---|---|
| 2,084,901 A * | 6/1937 | Eisenberg | ..... | A63B 69/3676 473/260 |
| 7,160,201 B2 * | 1/2007 | Dahl | ..... | A63B 69/3685 473/265 |
| 7,172,516 B2 * | 2/2007 | Wu | ..... | A63B 69/3685 473/226 |
| 2005/0101400 A1 * | 5/2005 | Dahl | ..... | A63B 69/3685 473/262 |
| 2006/0148583 A1 * | 7/2006 | Wu | ..... | A63B 69/3621 473/257 |

FOREIGN PATENT DOCUMENTS

| | | |
|---|---|---|
| KR | 20-0185797 Y1 | 6/2000 |
| KR | 20-2009-0000194 U | 1/2009 |
| KR | 20-2013-0003352 U | 6/2013 |
| KR | 10-2017-0090079 A | 8/2017 |

OTHER PUBLICATIONS

International Search Report dated Jul. 31, 2020 for PCT/KR2020/004993, citing the above reference(s).

* cited by examiner

*Primary Examiner* — Nini F Legesse
(74) *Attorney, Agent, or Firm* — CANTOR COLBURN LLP

(57) ABSTRACT

The present disclosure relates to a putting practice device for developing a putting motion for accurately striking a golf ball to a target spot, wherein the putting practice device can be used irrespective of a trajectory and curvature formed by a putter head when striking the golf ball. In addition, the present disclosure includes an auxiliary fastening unit for fastening the putter head to a mounting part.

5 Claims, 14 Drawing Sheets

GOLF PUTTING PRACTICE DEVICE AND AUXILIARY FASTENING UNIT FOR PUTTER HEAD

TECHNICAL FIELD

The present disclosure relates to a golf putting practice device, and more particularly, to a putting practice device for enabling repeated practice of a ball striking motion by setting such that a target spot to which a golf ball will go is perpendicular to a striking face of a putter head, and maintaining the striking face at the set angle before, during and after striking, when putting to strike the golf ball on the striking face of the putter head to the target spot, thereby developing an accurate putting motion.

In addition, the present disclosure includes an auxiliary fastening unit for fastening the putter head to a mounting part of the golf putting practice device.

The present application claims the benefit of Korean Patent Application No. 10-2019-0053418 (title: apparatus for training golf putting and auxiliary fastening unit for putter head, filed on May 8, 2019), the disclosure of which is incorporated herein in its entirety.

BACKGROUND ART

Putting refers to a stroke of putting a golf ball on the green into a hole using a putter. In putting, it is important to rotate the putter head in parallel to a line connecting the target spot and the golf ball. Additionally, many putting practice devices have been proposed.

FIG. 1 is a perspective view showing an example of a putting practice device.

As shown in the drawing, the putting practice device 100 includes two parallel rails 110, and a mounting part 130 that can move along the parallel rails 110. When a golf ball is hit on a putter head (not shown) connected to the mounting part 130, the mounting part 130 moves along the parallel rails 110, to help practice swinging the putter head in a target direction along the parallel rails 110.

However, a trajectory formed by the putter head when putting varies depending on a player's height, arm length and striking motion, and a trajectory of the parallel rails 110 is fixed, so the mounting part 130 may be separated from the parallel rails 110 before and after striking, and accordingly the putting practice device 100 fails to provide sufficient practice.

Moreover, in the putting practice device 100, the putter head is fastened onto an axis connecting two wheels, so the putter head is disposed at a higher position than its position in the real field, and accordingly a golf ball striking condition is different from the real one.

DISCLOSURE

Technical Problem

The present disclosure is directed to providing a golf putting practice device for enabling practice of a putting swing motion for striking a golf ball with a putter head to a target spot, which makes it possible to practice the swing motion for striking the golf ball with the putter head continually and repeatedly while constantly maintaining the target spot to which the golf ball will go perpendicular to the striking face of the putter head before, during and after striking.

The present disclosure is further directed to providing a golf putting practice device in which a putter head, a mounting part and parallel rails are constantly kept in close contact before, during and after striking.

The present disclosure is further directed to providing a golf putting practice device for striking at the same height as the putter head in the real field.

The present disclosure is further directed to providing an auxiliary fastening unit for fastening the putter head to the mounting part of the golf putting practice device to make it possible to practice putting with a common putter head.

Technical Solution

To achieve the above-described object, a golf putting practice device according to the present disclosure includes a support 1; a rotary body 2 installed in the support 1 rotatably around a rotation axis 32, having a circumferential shape, and including parallel rails 18; an elastic member 20 installed on one or two sides of the rotary body 2 with respect to the rotation axis 32 installed at a central part of the rotary body 2 to apply an elastic force to allow the rotary body 2 to make a rotational motion such that each of the two sides of the rotary body 2 moves up and down in an alternating manner; and a mounting part 4 which is movable along the parallel rails. The mounting part 4 is installed such that the putter head is detachably attached to the mounting part 4.

The mounting part 4 moves along the parallel rails 18 with the movement of the putter head when putting, and in response to a trajectory (preferably, a circumferential trajectory) formed by the putter head, the rotary body 2 makes the rotational motion around the rotation axis 32 by overcoming the elastic force of the elastic member 20 such that each of the two sides of the rotary body 2 moves up and down in an alternating manner, and accordingly the mounting part 4 and the parallel rails 18 may be kept in close contact and the mounting part 4 and the putter head may be kept in close contact, thereby moving the putter head along the parallel rails 18 even though the height, arm length and striking motion are different for each player.

The elastic member 20 is preferably installed between the support 1 and the rotary body 2. The elastic member 20 may be installed on two sides of the rotary body 2 with respect to the rotation axis 32, and in this instance, even when the mounting part 4 is disposed at the center of the rotary body 2, the mounting part 4 is subjected to the elastic force so that both the two sides of the rotary body 2 are rotated upward. As an alternative, the elastic member 20 may be installed on only one side of the rotary body 2 with respect to the rotation axis 32, and in this case, while the mounting part 4 is disposed at the center of the rotary body 2, the two sides of the rotary body 2 are kept in a parallel state at the same height, and when the mounting part 4 moves to one side where the elastic member 20 of the rotary body 2 is installed, the side of the rotary body 2 where the elastic member 20 is installed is subjected to the elastic force of causing upward rotation, and when the mounting part 4 moves to the opposite side, the side of the rotary body 2 where the elastic member 20 is installed is subjected to the elastic force of causing downward rotation.

The two parallel rails 18 may be formed in parallel along the lengthwise direction of the rotary body 2. Additionally, the mounting part 4 may include two wheels 3 installed movably along the two parallel rails: a connecting member 50 connecting the two wheels, and a protrusion 5,25 which protrudes from the connecting member 50 and is inserted into a fastening groove 22,23 of the putter head.

The connecting member 50 may include two ends 16 fastened to the wheels; and a central part 52 connecting the two ends 16 and having the protrusion 5,25.

The central part 52 is formed at a lower height than the two ends 16 and has at least a longer width than the putter head, thereby the putter head strikes a golf ball at a low height.

An auxiliary fastening unit 41,42,43,44 according to the present disclosure may include a body having a groove 37,45,46,47: and a fastening means to fasten the body to the putter head. The protrusion 5,25 of the mounting part is detachably inserted into the groove.

The body may be formed in the shape of a flat plate to cover one surface of the putter head.

Additionally, the fastening means may include a hook 38 installed on two sides of the body; and an elastic strap 36,39 installed in the hook 38 to connect the putter head to the body.

Advantageous Effects

The present disclosure has the following effects.

First, it is possible to continually and repeatedly practice a swing motion for striking a golf ball with a putter head while constantly maintaining a target spot to which the golf ball will go perpendicular to the striking face of the putter head before, during and after striking.

Second, although each player has different heights, arm lengths and striking motions, it is possible to constantly keep the putter head, the mounting part and the parallel rails in close contact before, during and after striking.

Third, it is possible to strike at the same height as the putting head in the real field.

Fourth, there is provided an auxiliary fastening unit for fastening the putter head to the mounting part of the golf putting practice device, which makes it possible to practice putting with a common putter head.

DESCRIPTION OF NUMERALS

Figure 1:
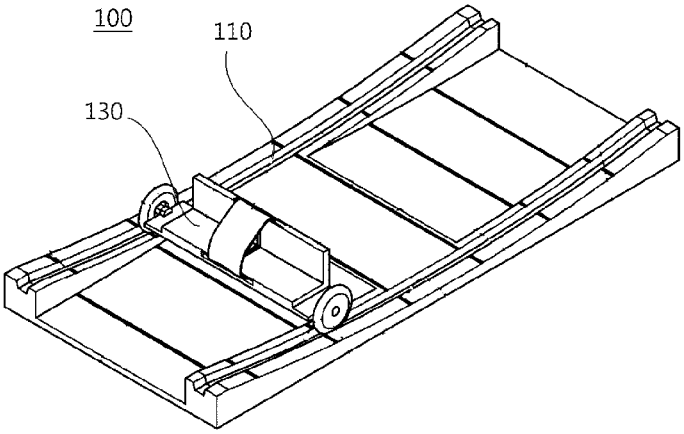
FIG. 1 is a perspective view showing an example of a putting practice device according to the related art.

| | |
|---|---|
| 1: | Support |
| 2: | Rotary body |
| 2a: | Cover |
| 2b: | Cutout formed in cover |
| 3, 30: | Wheel |
| 4: | Mounting part |
| 5. 25: | Protrusion |
| 7: | Step |
| 8: | Sloping plate |
| 9: | Golf ball |
| 10: | Ball connector |
| 11: | Stop |
| 12: | Stop hole |
| 13, 24: | Putter head |
| 14: | Striking face |
| 15: | Handle |
| 16: | End of connecting member |
| 17: | Ball movement groove |
| 18: | Parallel rail |
| 19, 26: | Bearing |
| 20, 20a: | Elastic member |
| 21: | Circumferential groove |
| 22, 23: | Fastening groove |
| 27, 28: | Groove formed in circumferential direction on outer peripheral surface of wheel |
| 31: | Teeth |
| 32: | Rotation axis |
| 33: | Rotation axis connection hole |
| 34: | Circumference |

-continued

| | |
|---|---|
| 35: | Adjustment screw |
| 36, 39: | Elastic strap |
| 37, 45, 46, 47: | Groove |
| 38: | Hook |
| 40: | Center point of rotation trajectory of putter head |
| 41, 42, 43, 44: | Auxiliary fastening unit |
| 48: | Base |
| 50: | Connecting member |
| 52: | Central part of connecting member |

DETAILED DESCRIPTION

Hereinafter, the present disclosure will be described in detail with reference to the accompanying drawings. Prior to the description, the terms or words used in the specification and the appended claims should not be construed as being limited to general and dictionary meanings, but rather interpreted based on the meanings and concepts corresponding to the technical spirit of the present disclosure on the basis of the principle that the inventor is allowed to define the terms appropriately for the best explanation. Therefore, the embodiments described herein and the elements shown in the drawings are just embodiments of the present disclosure, but not intended to fully describe the technical spirit of the present disclosure, so it should be understood that a variety of other equivalents and modifications could have been made thereto at the time that the application was filed.

Figure 2:
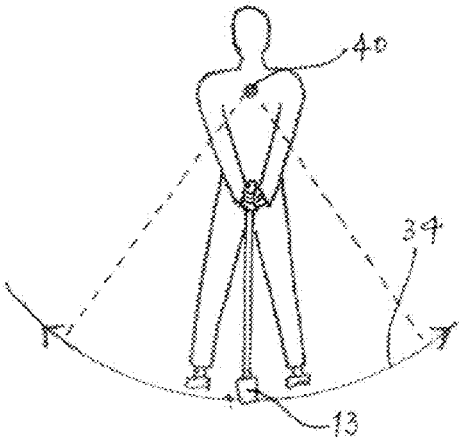
FIG. 2 is a diagram showing a putting trajectory.

FIG. 2 is a diagram showing a putting trajectory. To putt is to strike a golf ball on a putter head 13 in a target direction by a rotational motion on a circumference 34 of a pendulum with respect to a center point 40 of two shoulders. The putting practice device according to the present disclosure helps the rotational motion with the striking face of the putter head placed perpendicular to the target direction in the circumferential rotational motion.

Figure 3:
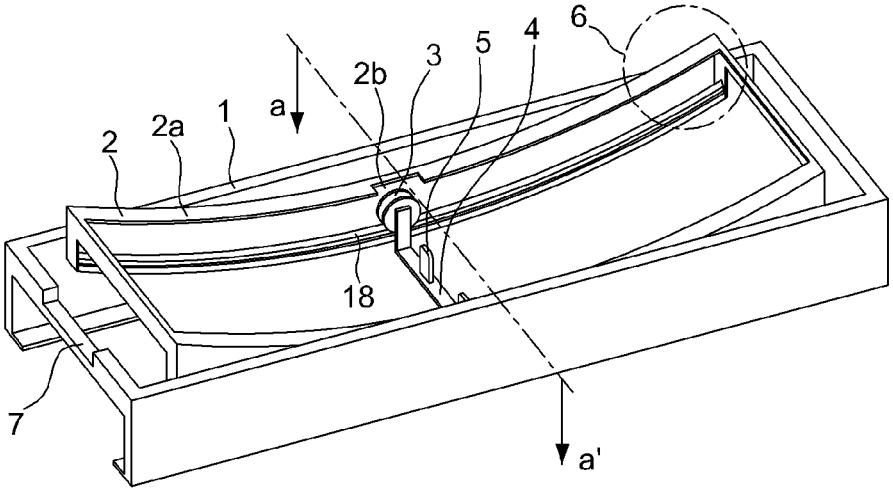
FIG. 3 is a perspective view showing a support, a rotary body and a mounting part of a putting practice device according to the present disclosure.
Figure 4:
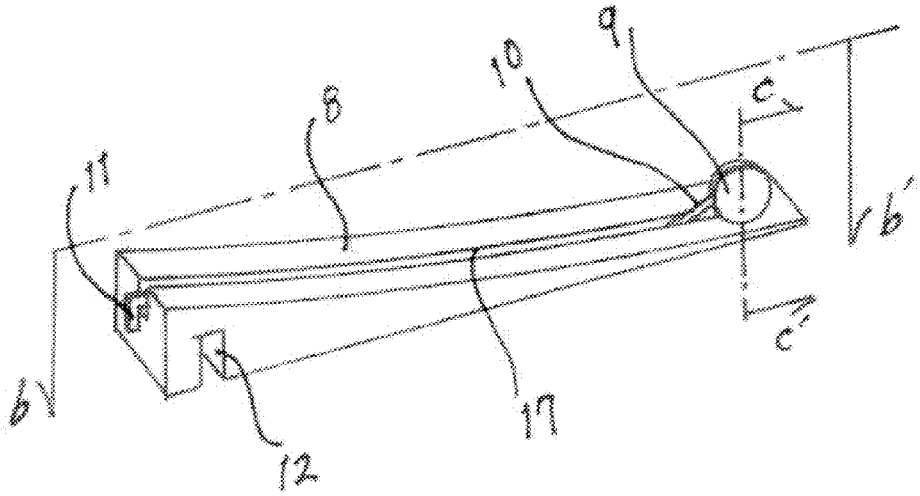
FIG. 4 is a perspective view showing a sloping plate of a putting practice device.
Figure 5:
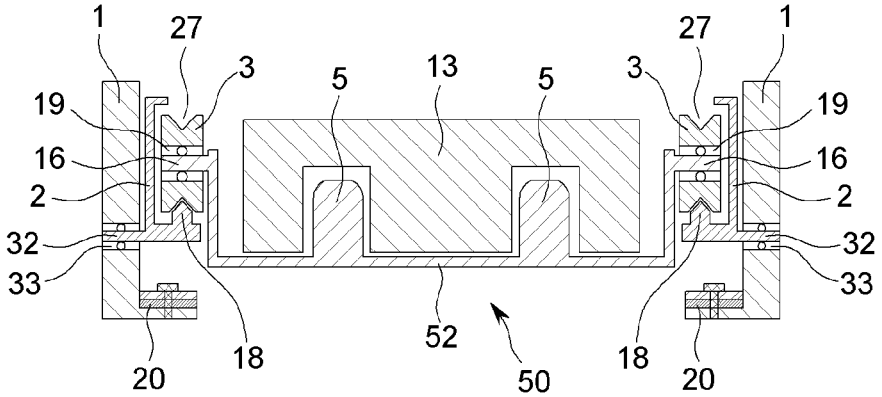
FIG. 5 is an enlarged cross-sectional view of FIG. 3 taken along a~a', showing the fastened putter head.

FIG. 3 is a perspective view showing a support, a rotary body and a mounting part of the putting practice device according to the present disclosure, FIG. 4 is a perspective view showing a sloping plate of the putting practice device, and FIG. 5 is a cross-sectional view of FIG. 3 taken along a~a'.

As shown in the drawings, the putting practice device includes the support 1, the sloping plate 8, the rotary body 2 rotatably installed in the support 1, the mounting part 4 movably installed in the rotary body 2, and an elastic member 20 to provide an elastic force to the rotary body 2.

The support 1 is a frame of an approximately rectangular shape, and has an internal space in which the rotary body 2 is installed. Among the four sides of the support 1, a rotation axis connection hole 33 is formed on two opposing sides, and a step 7 is formed on the side corresponding to the front end of the rotary body 2. A stop hole 12 of the sloping plate 8 is installed in the step 7.

Figure 6:
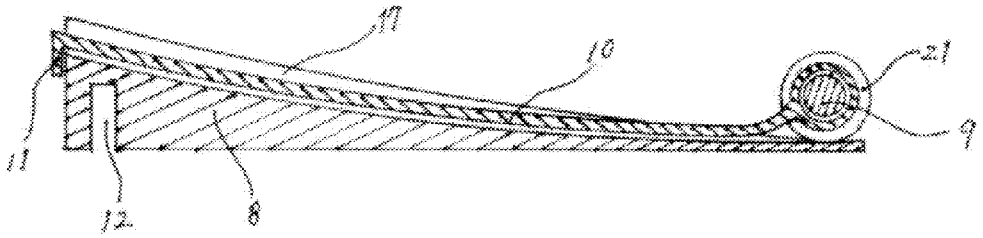
FIG. 6 is a cross-sectional view of FIG. 4 taken along b~b'.
Figure 7:
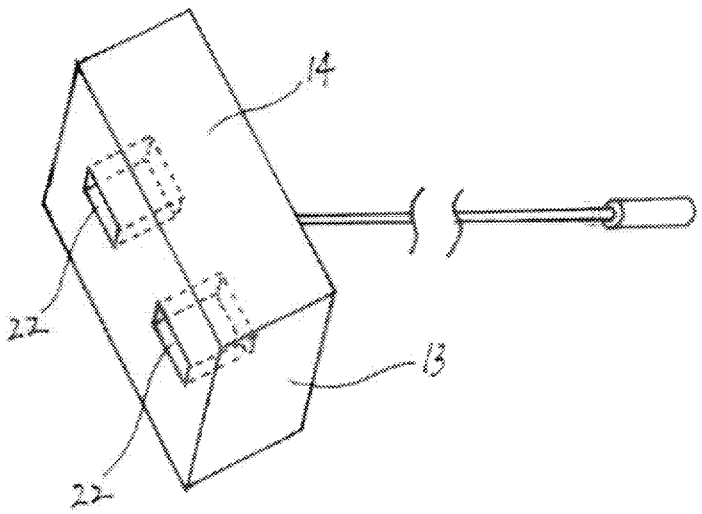
FIG. 7 is a perspective view showing a putter head that may be fastened to a mounting part.
Figure 8:
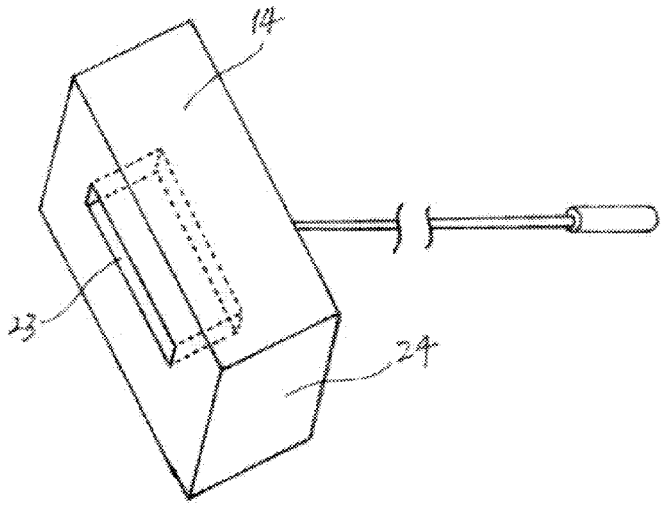
FIG. 8 is a perspective view showing another putter head that may be fastened to a mounting part.
Figure 9:
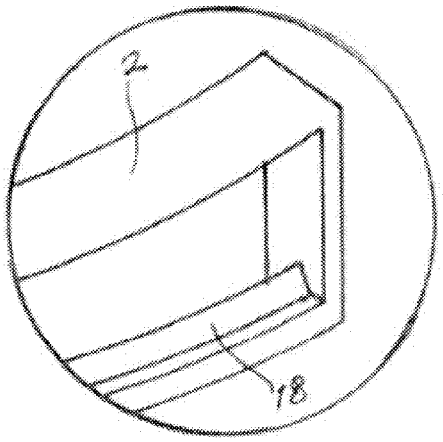
FIG. 9 is an enlarged view of section '6' of FIG. 3.
Figure 10:
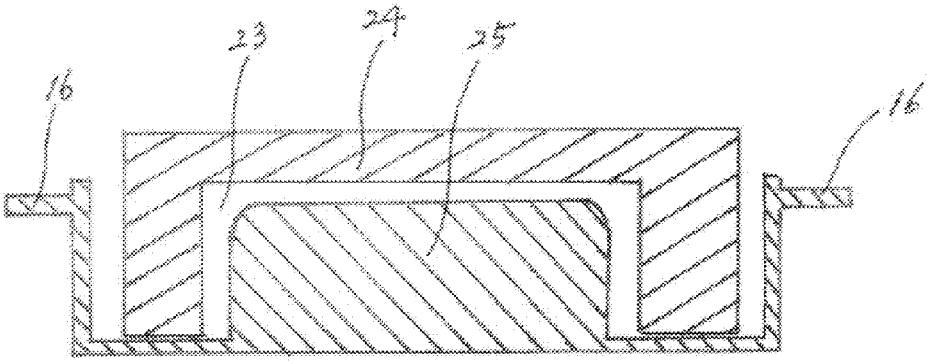
FIG. 10 is a cross-sectional view showing an example of a putter head fastened to a protrusion plate.

As shown in FIGS. 4 and 6, the sloping plate 8 has a sloped upper surface. The sloping plate 8 includes a ball movement groove 17 formed in the lengthwise direction, a ball connector 10 connected with a golf ball 9, and a stop 11.

The golf ball 9 is rotatably installed at one end of the ball connector 10, and the stop 11 is formed at the other end. A circumferential groove 21 is formed on the outer peripheral surface of the golf ball 9, and one end of the ball connector 10 is fastened to the groove 21, and accordingly the golf ball 9 is brought into rotation.

The ball connector 10 is installed to be inserted into the ball movement groove 17, and when the golf ball 9 is hit, the golf ball 9 and the ball connector 10 move up along the sloped surface, and in turn, move down along the sloped surface, and in this instance, when the stop 11 is held in the top of the sloping plate 8, the golf ball 9 stops and returns to the original position.

The rotary body 2 is rotatably installed in the support 1. Specifically, the rotary body 2 includes two parallel rails 18 formed along the lengthwise direction, and a rotation axis 32 that is inserted into the connection hole 33 installed in the support 1.

The two parallel rails 18 have a curved trajectory bending downward such that it is low at the center and the height increases as it goes toward two ends. Wheels 3 move along the trajectory.

Preferably, the two parallel rails 18 have a greater curvature than the trajectory formed by the putter head when putting, leading to rotation around the rotation axis 32 with the movement of the wheels 3 when putting. More preferably, the two parallel rails 18 have a circumferential trajectory (a circumferential trajectory of a part of a circle) having a greater curvature than the trajectory formed by the putter head when putting.

The two parallel rails 18 have an empty space between, and the sloping plate 8 and the mounting part 4 are installed in the empty space.

The rotation axis 32 protrudes outward from the two sides at the center of the rotary body 2, and is inserted into the connection hole 33 installed in the support 1.

Preferably, the rotary body 2 further includes a cover 2*a* and a cutout 2*b* formed in the cover 2*a*. The cover 2*a* extends along the lengthwise direction of the parallel rails 18 above the parallel rails 18. The cover 2*a* serves to prevent the separation of the wheels 3 when putting.

The cutout 2*b* may be formed by cutting the cover 2*a*, and when installing the mounting part 4 in the parallel rails 18, the wheels 3 and the two ends 16 may be inserted and installed through the cutout 2*b*.

The mounting part 4 is fastened to the putter head 13,24, and is installed in the parallel rails 18 movably along the parallel rails 18. The mounting part 4 includes two wheels 3, a connecting member 50 connecting the two wheels 3, and a protrusion 5,25 protruding from the connecting member 50.

Figure 11:
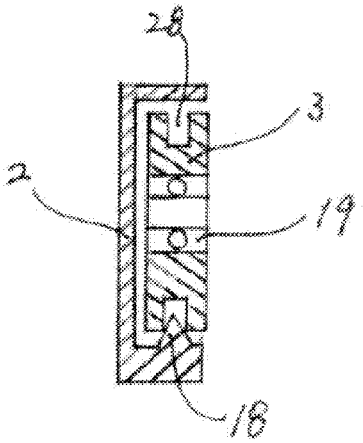
FIG. 11 is a cross-sectional view showing a connection relationship between a wheel and a parallel rail.
Figure 12:
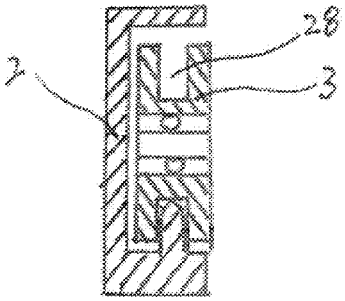
FIG. 12 is a cross-sectional view showing another connection relationship between a wheel and a parallel rail.

As shown in FIGS. 5, 11 and 12, the wheels 3 are rotatably installed at the two ends 16 of the connecting member 50. To this end, the two ends 16 are connected to the wheels 3 by a bearing 19.

Additionally, a groove 27 is formed along the circumferential direction on the outer peripheral surface of the wheels 3. The groove 27 prevents the wheels 3 from being separated from the parallel rails 18, and is preferably formed in a shape that matches (corresponds to) the shape of the parallel rails 18.

Figure 13:
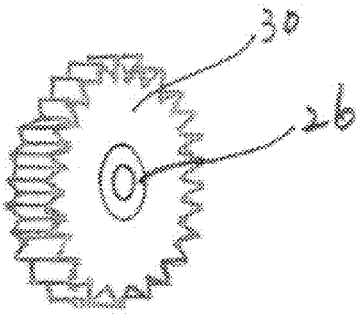
FIG. 13 is a perspective view showing another example of a wheel.
Figure 14:
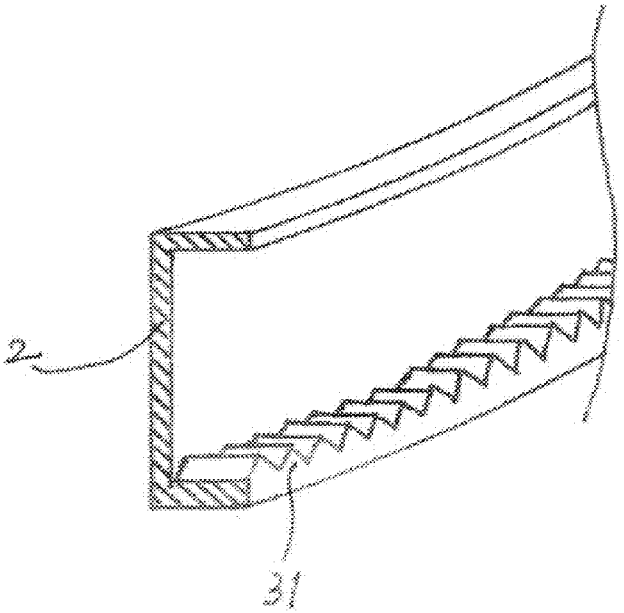
FIG. 14 is a partial perspective view showing another example of a parallel rail.

Meanwhile, as shown in FIGS. 13 and 14, when the parallel rails 18 have teeth 31, the wheels 30 may have teeth corresponding to the teeth 31 on the outer peripheral surface.

The connecting member 50 includes two ends 16 and a central part 52 between the two ends 16. The wheels 3 are rotatably installed at the two ends 16, and the protrusion 5 is formed in the central part 52. Additionally, the central part 52 is formed with a lower height than the two ends 16, and has a larger width than the width of the putter head 13,24.

Forming the central part 52 with a lower height than the two ends 16 is to strike the golf ball on the putter head 13,24 at the height which is as equal as possible to the height in the real field. In case that the connecting member 50 is formed in a straight line, the putter head 13,24 is spaced apart from the ground by the radius of the wheels 3 and the height of the rotation axis connection hole 33, resulting in a different striking condition from that of the real field, and the present disclosure forms the central part 52 lower than the two ends 16 and the protrusion 5,25 in the central part 52 such that that the width of the central part 52 is larger than the width of the putter head 13,24 to fasten the putter head 13,24 to the protrusion 5,25.

The protrusion 5,25 protrudes from the connecting member 50, and is inserted into a fastening groove 22,23 of the putter head 13,24. The fastening groove 22,23 is formed upward from the lower surface of the putter head 13,24.

The protrusion 5,25 is preferably formed in a shape that matches the shape of the fastening groove 22,23, and may be formed in various shapes to prevent the protrusion 5,25 and the fastening groove 22,23 from separating from each other. In case that the protrusion 5,25 and the fastening groove 22,23 separate from each other, a swing motion direction of the putter head 13,24 may move away from the parallel line direction of the parallel rails 18.

The elastic member 20 is installed in the support 1. FIG. 15*b* shows the elastic member 20 installed between the support 1 and the rotary body 2, and depicts no-striking on the putter head 13,24, i.e., the wheels 3 disposed at the center of the rotary body 2. Additionally, FIG. 15*a* shows the elastic member 20 with the rotary body 2 being removed.

Figure 15A:
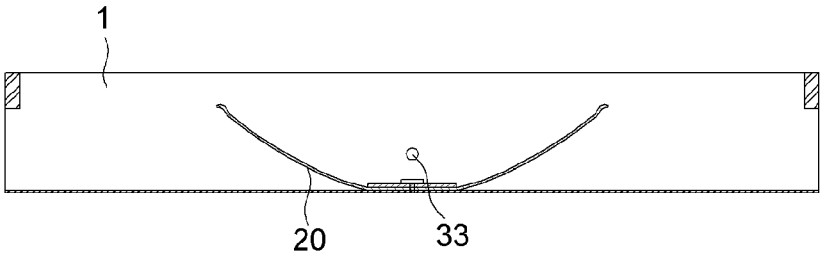
FIG. 15*a* is a cross-sectional view showing an elastic member installed in a support.
Figure 15B:
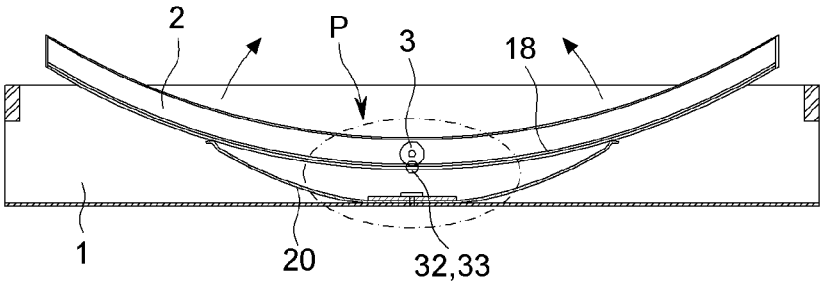
FIG. 15*b* is a cross-sectional view showing an elastic member and a rotary body installed in a support.
Figure 15C:
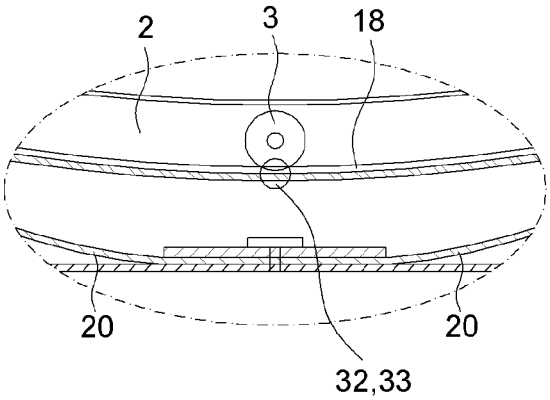
FIG. 15*c* is an enlarged view of section P of FIG. 15*b*.

As shown in FIGS. 15*a* to 15*c*, the elastic member 20 is installed such that the central part is fixed to the support 1 and two ends elastically support the rotary body 2. To this end, the elastic member 20 extends along the lengthwise direction of the rotary body 2 and has a smaller radius of curvature than the radius of curvature of the rotary body 2, and accordingly the elastic member 20 preferably applies an elastic force to the rotary body 2 in the arrow direction when slightly bent by the rotary body 2.

Meanwhile, although one elastic member 20 is shown as being fixed to the support 1 at the central part and extending to two sides, each of two separated elastic members 20 may be installed on each side.

Additionally, although the elastic member 20 is shown as extending to two sides with respect to the rotation axis 32, the elastic member 20 may extend to only one front end of the rotary body 2 (i.e., toward the step 7) with respect to the rotation axis 32. When the wheels 3 are disposed at the center of the rotary body 2, the two front ends of the rotary body 2 are at the same height from the support 1, and in response to the movement of the wheels 3 between the two front ends along the parallel rails 18, the elastic member 20 applies a pushing elastic force and a pulling elastic force to the rotary body 2.

Figure 15D:
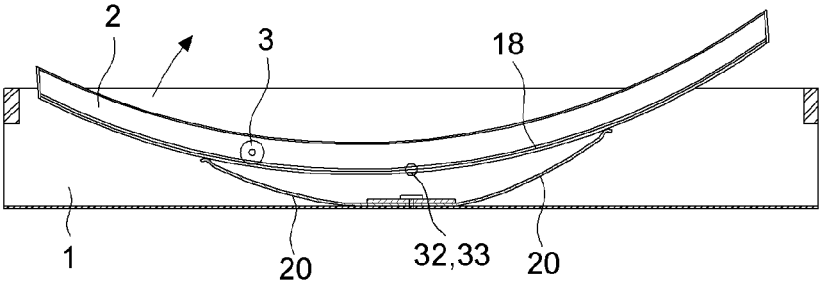
FIG. 15*d* is a cross-sectional view showing the rotation of a rotary body with the movement of a wheel by striking on a putter head.

FIG. 15*d* shows a case in which a stroke is made with the putter head 13,24. When the putting practice device is positioned such that the parallel rails 18 face the target spot, a stroke is made on the striking face of the putter head 13,24 perpendicular to the direction toward the target spot.

In this instance, the mounting part 4 moves along the parallel rails 18 together with the putter head 13,24, and accordingly the rotary body 2 rotates around the rotation axis 32, the elastic member 20 applies an elastic force to the rotary body 2 in the arrow direction to bring the parallel rails 18 and the wheels 3 into close contact and bring the mounting part 4 and the putter head 13,24 into close contact, the swing of the putter head 13,24 travels the parallel rails 18 by the close contact, and the striking face of the putter head 13,24 continuously maintains a predetermined angle toward the target direction before, during and after striking.

As described above, the golf putting practice device according to the present disclosure enables repeated practice of a ball striking motion by setting such that the target spot to which the golf ball will go is perpendicular to the striking face of the putter head 13,24, and maintaining the striking face at the set angle before, during and after striking, when putting to strike the golf ball with the striking face of the putter head 13,24 to the target spot.

Figure 16:
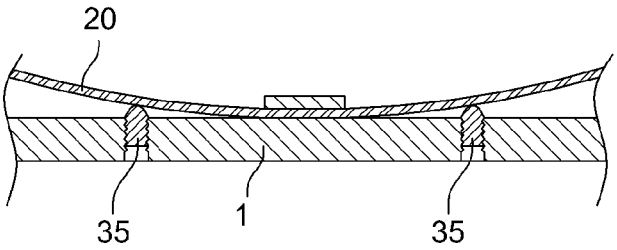
FIG. 16 is a cross-sectional showing an adjustment screw for adjusting an elastic force of an elastic member.

The elastic force of the elastic member 20 may increase or decrease as necessary. For example, as shown in FIG. 16, an adjustment screw 35 may be installed below the elastic member 20, and the elastic force of the elastic member 20 may be adjusted by adjusting the height of the adjustment screw 35.

Figure 17:
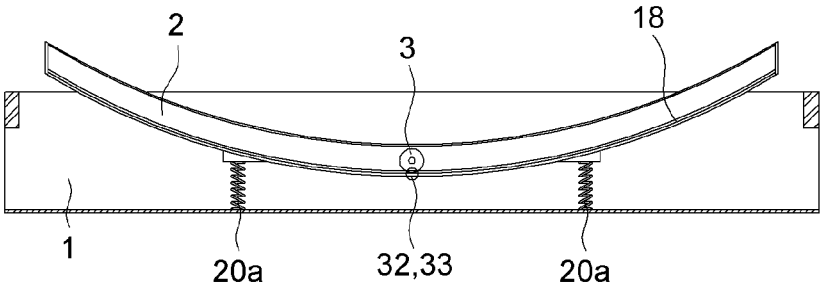
FIG. 17 is a cross-sectional view showing a variation of a support, a rotary body installed in the support and an elastic member which supports the rotary body.
Figure 18:
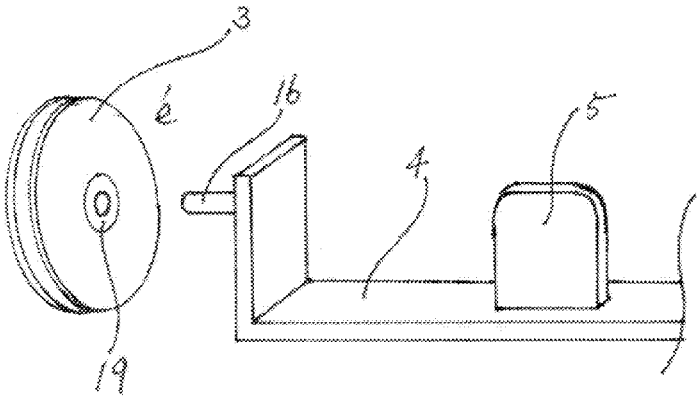
FIG. 18 is an exploded perspective view showing a connection relationship between a wheel and a connecting member.

FIG. 17 is a cross-sectional view of a variation of the elastic member 20*a*. The elastic member 20*a* is a spring installed on each of two sides of the rotation axis 32. Each spring 20*a* is installed on each of the two sides of the rotation axis 32 to apply an elastic force that pushes up the rotary body 2 to the rotary body 2.

Instead of the elastic spring 20*a*, an elastic plate such as a spring plate may be installed between the support 1 and the rotary body 2.

Meanwhile, in the present disclosure, the putter head 13,24 and the mounting part 4 are fastened by inserting the protrusion 5,25 into the fastening groove 22,23 of the putter head 13,24. Accordingly, the fastening groove 22,23 is formed on the lower surface of the putter head 13,24.

Figure 19:
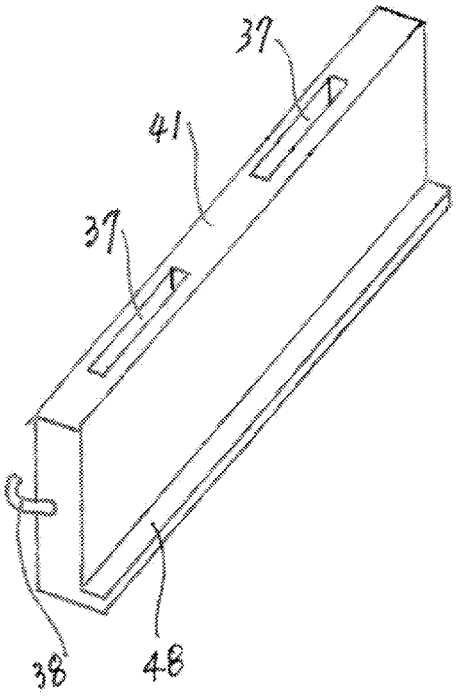
FIG. 19 is a perspective view showing an auxiliary fastening unit.
Figure 20:
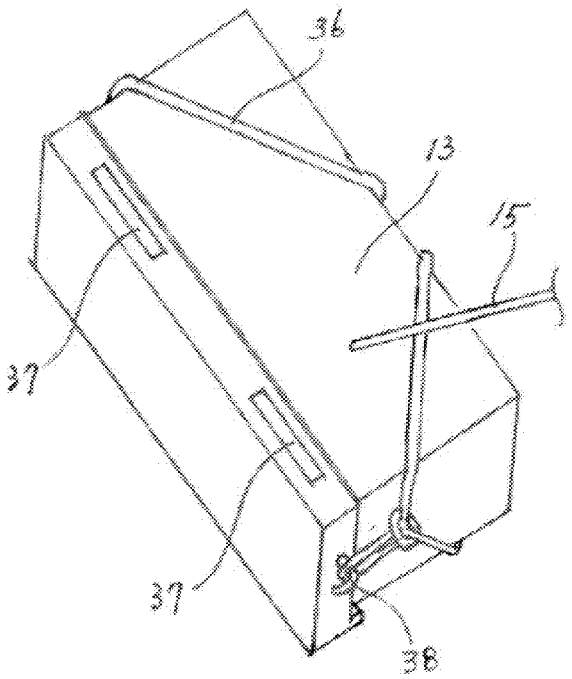
FIG. 20 is a perspective view showing a putter head fastened to the auxiliary fastening unit of FIG. 19.
Figure 21:
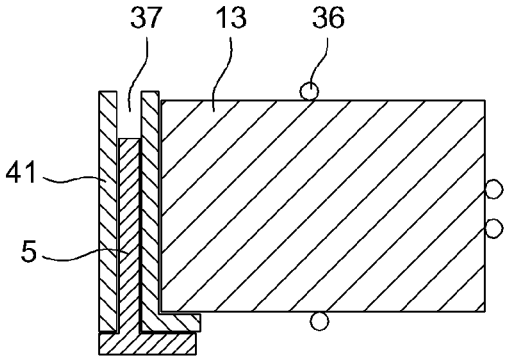
FIG. 21 is a cross-sectional view showing a putter head fastened to a mounting part by the auxiliary fastening unit of FIG. 19.

However, using an auxiliary fastening unit, it is possible to fasten a common putter head having no fastening groove 22,23 to the mounting part 4. As shown in FIGS. 19 to 21, the auxiliary fastening unit 41 includes a body, and a fastening means to fasten the body to the putter head 13,24.

The body is a flat plate including a groove 37 and a base 48. The protrusion 5 is inserted and fastened to the groove 37. Additionally, the base 48 protrudes in the shape of L on the bottom of the body, and supports the putter head 13,24.

Figure 24:
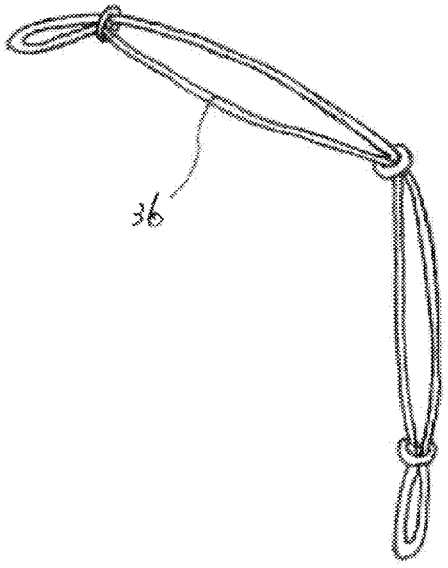
FIG. 24 is a perspective view showing an elastic strap.

The fastening means includes a hook 38 installed in the body, and an elastic strap 36 that is fastened to the hook 38. The hook 38 is installed on one side of the body, preferably two sides of the body. Additionally, the elastic strap 36 is a strap having an elastic property, and as shown in FIGS. 20 and 24, the elastic strap 36 fixes the putter head 13,24 to the body by connecting two ends to the hook 38.

Figure 25:
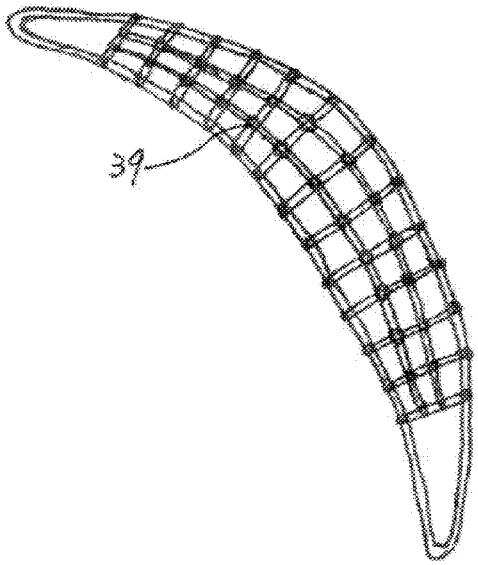
FIG. 25 is a perspective view showing a variation of an elastic strap.

The elastic strap 36 may be formed in various structures. For example, as shown in FIG. 25, the elastic strap 39 may be formed in the shape of a net.

Figure 22:
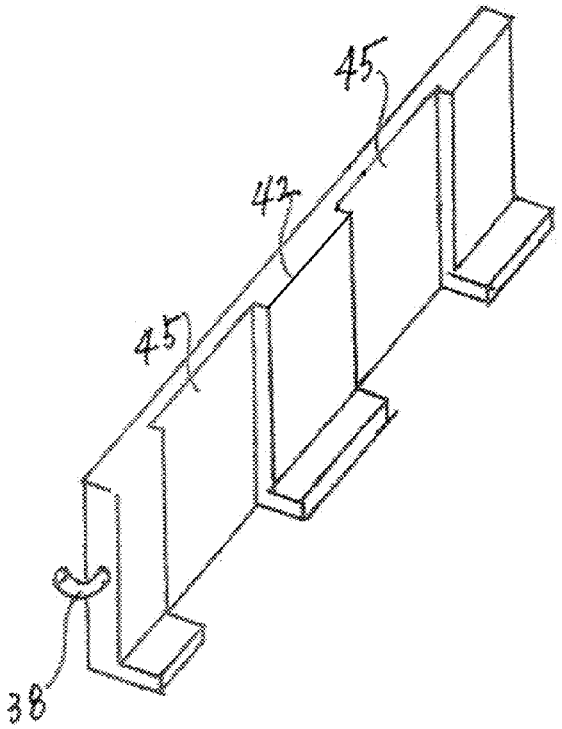
FIG. 22 is a perspective view showing another auxiliary fastening unit.
Figure 23:
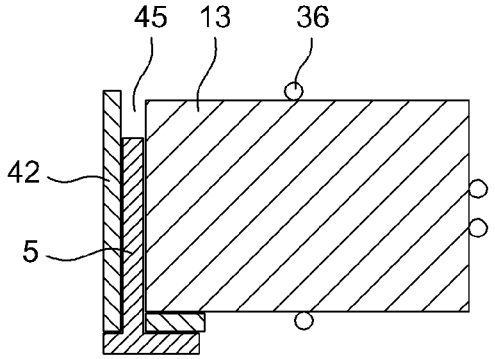
FIG. 23 is a cross-sectional view showing a putter head fastened to a mounting part by the auxiliary fastening unit of FIG. 22.

Meanwhile, FIG. 22 shows a variation of the auxiliary fastening unit, and the auxiliary fastening unit 42 is different from the auxiliary fastening unit 41 in that a groove 45 is formed on the side of the body. As shown in FIG. 23, the protrusion 5 is inserted and fastened between the striking face of the putter head 13 and the side of the body (i.e., the groove 45).

Figure 26:
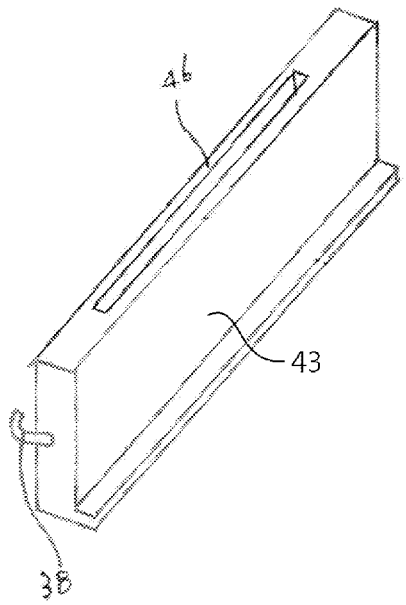
FIG. 26 is a perspective view showing still another auxiliary fastening unit.
Figure 27:
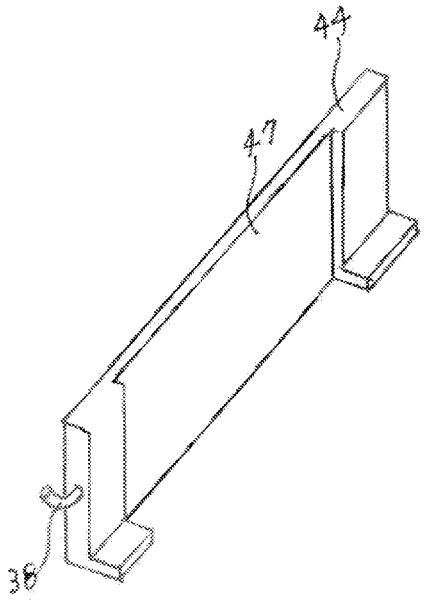
FIG. 27 is a perspective view showing yet another auxiliary fastening unit.

FIGS. 26 and 27 show another variation of the auxiliary fastening unit, and the auxiliary fastening unit 43 of FIG. 26 is different from the above-described auxiliary fastening units in that only one groove 46 is formed in the body, and the auxiliary fastening unit 44 of FIG. 27 is different from the above-described auxiliary fastening units in that only one fastening groove 47 is formed on the side of the body. The auxiliary fastening unit 43,44 is connected to the putter head by the same method as the above-described method.

What is claimed is:

1. A golf putting practice device, comprising:

a support;

a rotary body installed in the support rotatably around a rotation axis installed at a central part, including parallel rails, and having a greater curvature than a trajectory formed by a putter head when putting;

an elastic member installed on one or two sides of the rotary body with respect to the rotation axis to apply an elastic force to allow the rotary body to make a rotational motion such that two front ends of the rotary body move up and down in an alternating manner; and a mounting part which is movable along the parallel rails, wherein the mounting part is installed such that the putter head is detachably attached to the mounting part, and the mounting part moves along the parallel rails with the movement of the putter head when putting, and in response to the trajectory formed by the putter head, the rotary body makes the rotational motion around the rotation axis by overcoming the elastic force of the elastic member such that the two front ends of the rotary body move up and down in an alternating manner, and accordingly the mounting part and the parallel rails are kept in close contact, and the mounting part is kept tightly fastened to the putter head.

2. The golf putting practice device according to claim 1, wherein the elastic member is an elastic spring or an elastic plate installed between the support and the rotary body, and in response to the movement of the mounting part along the parallel rails, the elastic member applies the elastic force to the rotary body to push up or pull down the rotary body.

3. The golf putting practice device according to claim 1, wherein two parallel rails are formed in parallel along a lengthwise direction of the rotary body, and the mounting part includes:

two wheels movably installed along the two parallel rails;

a connecting member connecting the two wheels; and a protrusion which protrudes from the connecting member, and is inserted into a fastening groove of the putter head.

4. The golf putting practice device according to claim 3, wherein the connecting member includes:

two ends fastened to the wheels; and a central part connecting the two ends, and having a protrusion, and wherein the central part is formed at a lower height than the two ends and has at least a longer width than the putter head, thereby the putter head strikes a golf ball at a low height.

5. The golf putting practice device according to claim 3, wherein the rotary body includes a cover, and the cover extends along the parallel rails above the parallel rails to prevent separation of the wheels.

* * * * *